US007859174B2

(12) United States Patent
Kakisaka

(10) Patent No.: US 7,859,174 B2
(45) Date of Patent: Dec. 28, 2010

(54) METAL VAPOR DISCHARGE LAMP

(75) Inventor: Shunsuke Kakisaka, Osaka (JP)

(73) Assignee: Panasonic Corporation, Osaka (JP)

( * ) Notice: Subject to any disclaimer, the term of this patent is extended or adjusted under 35 U.S.C. 154(b) by 273 days.

(21) Appl. No.: 12/159,771

(22) PCT Filed: Jan. 17, 2007

(86) PCT No.: PCT/JP2007/050595

§ 371 (c)(1),
(2), (4) Date: Jun. 30, 2008

(87) PCT Pub. No.: WO2007/088729

PCT Pub. Date: Aug. 9, 2007

(65) Prior Publication Data

US 2009/0206753 A1 Aug. 20, 2009

(30) Foreign Application Priority Data

Feb. 1, 2006 (JP) ..... 2006-024433

(51) Int. Cl.
*H01J 1/02* (2006.01)

(52) U.S. Cl. ..... 313/25

(58) Field of Classification Search ..... 313/17, 313/25, 493, 634

See application file for complete search history.

(56) References Cited

U.S. PATENT DOCUMENTS 5,576,591 A 11/1996 Block et al.
2002/0158567 A1 10/2002 Arakawa et al.
2007/0182333 A1 8/2007 Kakisaka et al.
2009/0206753 A1 8/2009 Kakisaka

FOREIGN PATENT DOCUMENTS

| | | |
|---|---|---|
| JP | 04-81438 | 7/1992 |
| JP | 6-251756 | 9/1994 |
| JP | 06-260082 | 9/1994 |
| JP | 07-195242 | 8/1995 |
| JP | 9-17330 | 1/1997 |
| JP | 9-167599 | 6/1997 |
| JP | 9-320541 | 12/1997 |
| JP | 10-283996 | 10/1998 |
| JP | 11-96973 | 4/1999 |
| JP | 2003-31004 | 1/2003 |
| JP | 2003-45218 | 2/2003 |
| JP | 3115450 | 9/2005 |
| JP | 3115450 | 11/2005 |
| JP | 2007-207552 | 8/2007 |
| WO | 2006/001166 | 1/2006 |

*Primary Examiner*—Vip Patel

(57) ABSTRACT

A metal vapor discharge lamp comprising an arc tube, an airtight tube housing the arc tube, and a base bonded to one end of the airtight tube with use of an adhesive, wherein the airtight tube is covered by a protective tube to improve safety as compared to a case where the protective tube is simply bonded to the base with an adhesive. The protective tube is fixed to the base with a double fall-off prevention structure, and latched to the base when a force including gravity and inertia acts on the protective tube toward the closed end of the protective tube in the axial direction thereof. The above-described structure eliminates the need of arranging the protective wall for securing the safety on the side of a lighting device on which the metal vapor discharge lamp is to be fixed, thereby preventing the lighting device from becoming large in size.

6 Claims, 12 Drawing Sheets

FIXING DIRECTION OF LIGHT FASTENING PART

FIXING DIRECTION OF LIGHT FASTENING PART

FIXING DIRECTION OF LIGHT FASTENING PART

FIXING DIRECTION OF LIGHT FASTENING PART

METAL VAPOR DISCHARGE LAMP

TECHNICAL FIELD

The present invention relates to a metal vapor discharge lamp.

BACKGROUND ART

In recent years, there has been an increasing demand for interior lighting devices, especially for commercial lighting devices, to be smaller and brighter. As a light source to meet the demand, metal halide lamps (HID lamps) have been attracting attention.

To meet the demand of smaller lighting devices for interior use, a first conventional metal halide lamp includes, as shown in FIG. 11, an outer tube 111 that is made of hard glass, an arc tube 130 that is provided inside the outer tube 111, and a sleeve 120 that is made of fused quartz, arranged between the outer tube 111 and the arc tube 130, and surrounds the arc tube 130 (see Patent Document 1).

Furthermore, to make the lighting devices even smaller, a second conventional metal halide lamp includes, as shown in FIG. 12, a fused quartz tube 311 that has a closed part at one end, and a pinch seal part 321 at the other end, and an arc tube 330 arranged inside the fused quartz tube 311 (see Patent Document 2).

Patent Document 1: Japanese Laid-Open Patent Application No. 10-283996; and

Patent Document 2: Japanese Laid-Open Patent Application No. 11-96973.

DISCLOSURE OF THE INVENTION

The Problems the Invention is Going to Solve

Although the second conventional metal halide lamp can meet the demand for smaller lighting devices, the arc tube 330 is covered by only a single fused quartz tube 311. Therefore, when this metal halide lamp is used for a lighting device, the lighting device needs a front glass for safety measures against the breakage of the arc tube 330 and harmful ultraviolet irradiation. However, the use of such a front glass requires a holding mechanism to hold the glass, resulting in the lighting device becoming larger.

In view of the above-described problem, the object of the present invention is to provide a metal vapor discharge lamp that ensures safety while preventing the device from becoming larger.

Means to Solve the Problems

In order to achieve the above-described object, the present invention provides a metal vapor discharge lamp including an arc tube, an airtight tube housing the arc tube, and a base bonded to one end of the airtight tube with use of an adhesive, wherein the airtight tube is covered by a protective tube, and the protective tube has been fixed to the base by a double fall-off prevention structure including a first fall-off prevention structure and a second fall-off prevention structure so that the protective tube is prevented from falling off the base.

Effects of the Invention

As described above, the metal vapor discharge lamp of the present invention has a structure in which the airtight tube is covered by a protective tube that is fixed to the base with a double fall-off prevention structure including a first fall-off prevention structure and a second fall-off prevention structure to prevent the protective tube from falling off the base. Therefore, even when a force including gravity and inertia acts on the protective tube toward the closed end of the protective tube along the axial direction thereof, the protective tube does not easily fall off, and thereby improves safety against the protective tube falling off.

It is preferable that (i) the airtight tube is made of a material that can absorb ultraviolet rays, and (ii) the protective tube is made, for example, of a material that can absorb ultraviolet rays having a lower wavelength and is strong enough to resist a burst of the arc tube, since this ensures safety against the breakage of the arc tube and harmful ultraviolet irradiation.

Compared to a case where a protective tube is simply bonded to the base with a heat-resistant adhesive, the protective tube of the metal vapor discharge lamp according to the present invention does not easily fall off, and thus advantageous since the safety against the breakage of the arc tube and harmful ultraviolet irradiation is increased.

When the first fall-off prevention structure is to bond with use of the adhesive, and the second fall-off prevention structure is to latch with use of a latching part and a latched part, safety against the protective tube falling off is improved as compared to the case where the protective tube is simply bonded to the base with the adhesive.

When the base includes the latching part and the protective tube includes the latched part, so that the base latches the protective tube, it is possible to prevent the protective tube from easily falling off, even when a force including gravity and inertia acts on the protective tube. As a result, safety against the protective tube falling off is improved as compared to the case where the protective tube is simply bonded to the base with the adhesive.

Therefore, in the metal vapor discharge lamp according to the present invention, even if the adhesive has lost a bonding function due to a usage environment of a user, and a force including gravity and inertia acts on the protective tube, the protective tube is latched to the base and thereby preventing the protective tube from easily falling off.

When the one end of the airtight tube is pinch-sealed, the one end that has been pinch-sealed is inserted in a bonding part of the base, the bonding part is inserted in an opening of the protective tube, and the latching part is arranged in the bonding part, (i) the bonding member that bonds the airtight tube to the base, and (ii) a member for latching the protective tube can be integrated into one in the bonding part. Therefore, compared to a case where the protective tube is bonded to the base by crimping the base, and a stem is provided in the vicinity of an opening of the protective tube, the length of the protective tube in the axial direction of the discharge lamp according to the present invention is shorter. In other words, the length of the metal vapor discharge lamp in the axial direction is shorter, which makes it possible to prevent the metal vapor discharge lamp from becoming large in size.

When the bonding part has an outer peripheral surface on which the latching part is arranged, arranging the latching part is easier than a case where a projecting part arranged on the outer peripheral surface of the protective tube is latched by a recessed part arranged on the inner peripheral surface of the base.

When the latched part and the latching part are one of (i) a combination in which (a) the latched part is a projecting part arranged on an inner peripheral surface of the protective tube in a radial direction thereof, and (b) the latching part is a recessed part arranged on a surface opposite from the inner peripheral surface of the protective tube in the bonding part, and latches the projecting part of the protective tube, and, (ii) a combination in which (a) the latched part is a recessed part arranged on a surface opposite from the outer peripheral surface of the bonding part, and (b) the latching part is a projecting part arranged on the surface opposite from the inner peripheral surface of the protective tube in the bonding part in a radial direction thereof, and latches the recessed part of the bonding part, latching the protective tube to the base is realized easily.

It is preferable that the base is rotated and fixed to a socket corresponding thereto, and the recessed part latches the projecting part when the base is rotated, since it can prevent the protective tube from falling off when the metal vapor discharge lamp is attached to a lighting device.

It is preferable to attach the above-described metal vapor discharge lamp to the lighting device for interior use. The metal vapor discharge lamp of the present invention has the protective tube. Therefore, when compared to metal vapor discharge lamps that do not have the protective tubes, the metal discharge lamp of the present invention eliminates the need of arranging, in the lighting device, the protective wall for securing the safety against the breakage of the arc tube, which makes it possible to prevent the lighting device from becoming large and lighten the weight of the lighting device. dr

DESCRIPTION OF CHARACTERS

Figure 1:
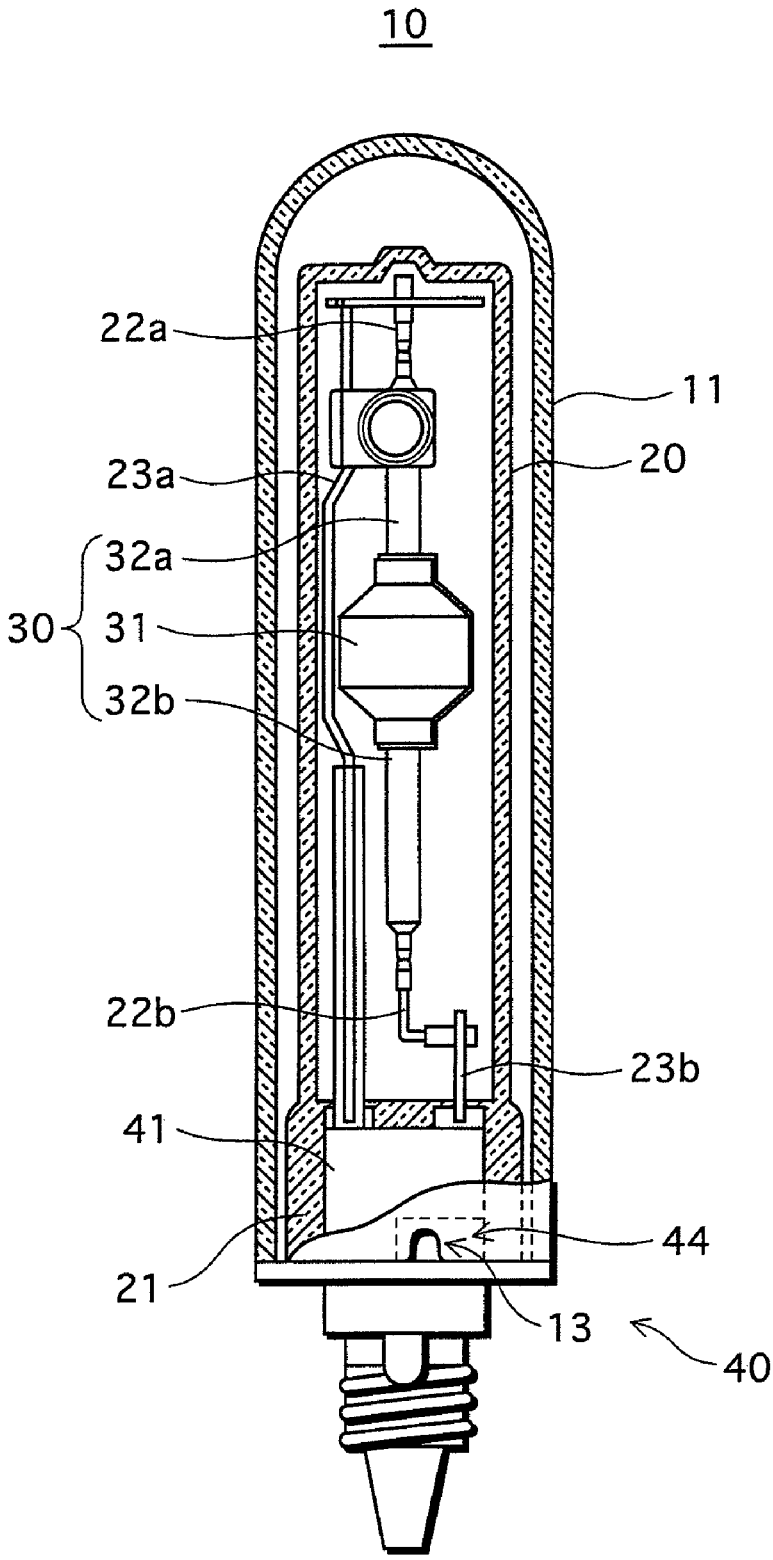
FIG. 1 is a schematic exploded view showing a metal halide lamp of a first embodiment.

10 metal halide lamp
11, 51 protective tubes
12 opening
13, 63 projecting parts
20 airtight tube
21 pinch seal part
22*a*, 22*b* feeders
23*a*, 23*b* power supply lines
30 arc tube
31 light emitting part
32*a*, 32*b* thin-tube parts
40, 60, 70, 80 bases
41, 61, 71, 81 bonding parts
41*a*, 71*a* slits
42, 72 terminals
43, 73, 83 flange parts
44, 44*b*, 44*c*, 44*d*, 44*e*,
54, 74, 84*d*, 84*e* recessed parts

BEST MODE FOR CARRYING OUT THE INVENTION

First Embodiment

<Structure of Discharge Lamp 10>

FIG. 1 is a schematic view of a metal halide lamp (the power consumption is 70 [W], for example) in the first embodiment, and shows parts of a protective tube and an airtight tube in cross section.

As shown in FIG. 1, a metal halide lamp 10 of the first embodiment includes a protective tube 11 that is substantially cylindrical (except one end of the tube) and has a closed part at one end and an opening at an other end, an airtight tube 20 housed in the protective tube 11, an arc tube 30 that is housed in the airtight tube 20 and filled with metal halide, and a base 40 for closing the opening at the other end of the protective tube 11. The metal halide lamp 10 has a structure, between the protective tube 11 and the base 40, for preventing the protective tube 11 from falling off. The detailed structure of the protective tube 11 is described below.

The airtight tube 20 is, for example, made of fused quartz, and the outer diameter is 15.5 [mm], and the inner diameter is 13.0 [mm]. Also, the airtight tube 20 is originally a cylindrical valve whose one end is closed and whose other end is open, and has a pinch seal part 21 formed at the other end. The pinch seal part 21 is formed by being crushed and sealed with use of a well-known pinch seal method after the arc tube 30 is housed in the airtight tube 20. Furthermore, the airtight tube 20 is made of fused quartz, and therefore has a function that blocks ultraviolet light, which is harmful to humans, among lights emitted from the arc tube 30. Note that the airtight tube 20 is not always made of fused quartz, and may be made of a material that has a function that can absorb ultraviolet rays and transmit visible light. The inside of the airtight tube 20 may be maintained at atmosphere pressure, a substantial vacuum atmosphere, or a reduced-pressure atmosphere or lower where the inside is filled, for example, with an inactive gas such as nitrogen gas.

Note that the area between the protective tube 11 and the airtight tube 20 may be maintained at atmosphere pressure, vacuum atmosphere, or a reduced-pressure atmosphere. It is also possible that the area is filled with an inactive gas such as nitrogen gas at a predetermined pressure.

The envelope of the arc tube 30 is made of translucent ceramics such as polycrystalline alumina, has a pair of electrodes (not shown in figures) inside, a light emitting part 31 that forms a discharge space, and thin-tube parts 32*a* and 32*b*. The thin-tube parts 32*a* and 32*b* extend from both ends of the light emitting part 31, and the diameters of the thin-tube parts 32*a* and 32*b* are smaller than the light emitting part 31. The arc tube 30 is filled with predetermined amounts of (i) metal halide as a luminescence material, such as sodium iodide, thallium iodide, and indium iodide, (ii) mercury as a buffer gas, and (iii) rare gas as an auxiliary starting gas, such as argon gas. Also, inside the arc tube 30, feeders 22*a* and 22*b* that are connected to the electrodes are sealed by a sealing material at the other ends of the thin tubes 32*a* and 32*b*, in a state where the feeders 22*a* and 22*b* extend from the other ends of the thin tubes 32*a* and 32*b*. Note that the other ends of the feeders 22*a* and 22*b* are connected to power supply lines 23*a* and 23*b* that are electrically connectable to the outside of the metal halide lamp via the base 40 with use of a well-known method.

<Structure of Protective Tube 11>

Figure 2A:
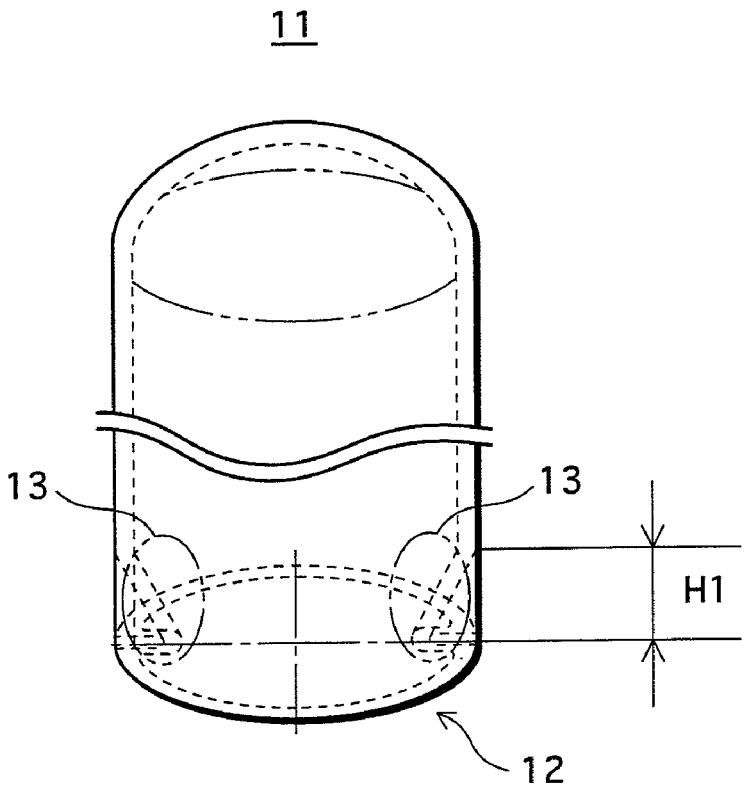
FIG. 2A is a schematic perspective view showing a protective tube of the first embodiment.
Figure 2B:
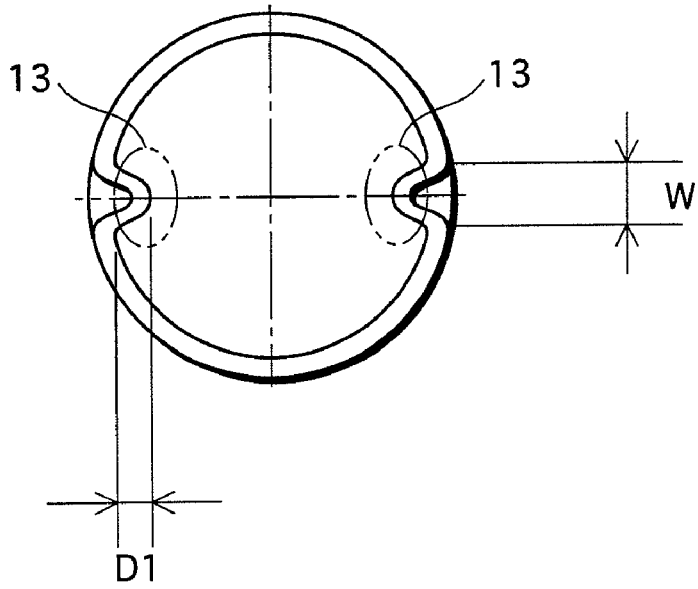
FIG. 2B is a schematic structure view showing the protective tube seen from the side of an opening.

FIG. 2A is a schematic perspective view showing the protective tube 11 of the first embodiment, and FIG. 2B is a schematic structure view showing the protective tube 11 seen from the side of an opening 12.

The protective tube 11 is, for example, made of hard glass, and the outer diameter is set to 20.5 [mm] and the inner diameter is set to 17.9 [mm]. Therefore, the protective tube 11 is strong enough to resist a burst of the arc tube 30, and can absorb ultraviolet rays having lower wavelength that are difficult to be absorbed by the airtight tube 20.

As shown in FIG. 2B, two projecting parts (latched parts) 13 that project from the inner peripheral surface of the protective tube 11 into the central axis thereof in the longitudinal direction are arranged at the edges of the opening 12, and the tips of the projecting parts 13 are arranged opposite to each other. The projecting part 13 is, for example, formed in a manner that (i) a height Dl that is a height from the inner peripheral surface of the protective tube 11 is 1.0 [mm], (ii) a length Hl that is a length from an opening edge of the protective tube 11 to the inside thereof along the axial direction of the protective tube 11 is 2.0 [mm], and (iii) a width W that is a width measured in a substantial circumferential direction of the protective tube 11 is 2.5 [mm].

Note that the projecting part 13 is not limited to the above-described structure and measurements if the projecting part 13 can be latched by a recessed part of the below-described bonding part.

In the present embodiment, the projecting part 13 is made in a manner that the opening edge of the protective tube 11 is recessed from the outer periphery toward the axis of the protective tube 11.

<Structure of Base 40>

Figure 3A:
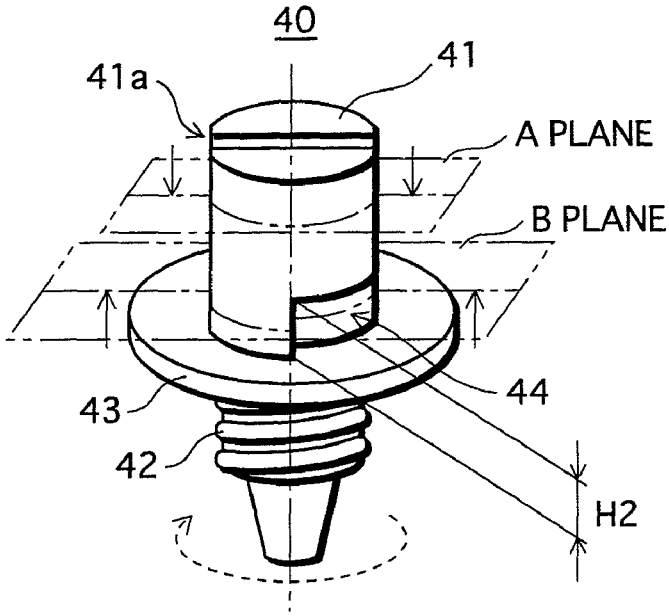
FIG. 3A is a schematic structure view showing a base of the first embodiment.
Figure 3B:
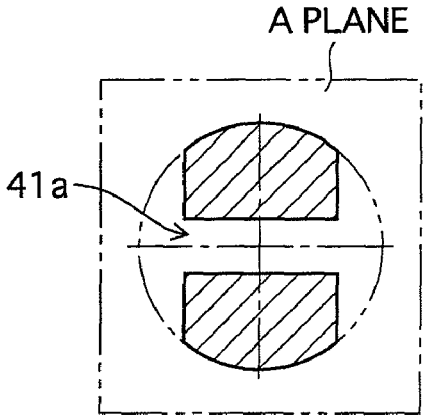
FIG. 3B is a sectional view showing the base taken along the plane A and viewed in the direction of the arrows.
Figure 3C:
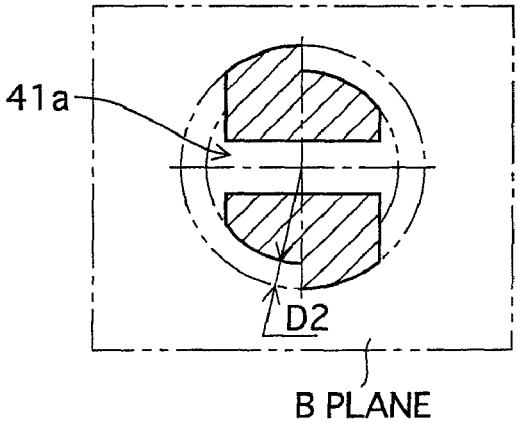
FIG. 3C is a sectional view showing the base taken along the plane B and viewed in the direction of the arrows.

FIG. 3A is a schematic structure view of the base 40, FIG. 3B is a sectional view showing the base 40 taken along the plane A and viewed in the direction of the arrows, and FIG. 3C is a sectional view showing the base 40 taken along the plane B and viewed in the direction of the arrows. As shown in FIG. 3A, the base 40 includes a terminal part 42, a flange part 43, and a bonding part 41 that is arranged on the main surface of the flange part 43. The outer shape of the bonding part 41 is substantially in a cylindrical shape. The bonding part 41 is made of a substance having a function as an insulator such as steatite ceramics, and the central axis thereof in the longitudinal direction passes through the center of the main surface of the flange part 43. In the bonding part 41, a slit 41*a* is arranged to support the pinch seal part 21 of the airtight tube 20. The slit 41*a* is formed by cutting the bonding part 41 in the longitudinal central axis direction in a manner that the cut part includes (i) the central axis in the longitudinal direction, and (ii) the outer peripheral surface. The airtight tube 20 is supported by the pinch seal part 21 that is inserted in the slit 41*a* and bonded to the base 40 with a heat-resistant adhesive.

Note that in the bonding part 41, the slit 41*a* does not necessarily need to be formed by cutting the bonding part 41 including the outer peripheral surface. Any type of slit 41*a* is acceptable as long as the slit is formed according to the measurement of the pinch seal part 21 of the airtight tube 20. For example, it is possible to arrange, on the top of the bonding part 41, a recessed part that is recessed in the longitudinal central axis direction of the bonding part 41, and the pinch seal part 21 of the airtight tube 20 may be secured in the recessed part.

The bonding part 41 that is substantially in a cylindrical shape includes a part that is split into two sections by the above-described slit 41*a*. Also, a recessed part (latching part) 44 for latching the above-described projecting part 13 is provided on the peripheral curved surface of each split section. The inner contour of the cross section obtained by cutting the recessed part 44 vertically to the circumferential direction is substantially in a U-shape, a rectangular shape whose one side is open, a trapezoidal shape, or a square shape.

(First Variation of Recessed Part)

The following describes a first variation of the recessed part. As shown in FIG. 3A, the recessed part 44 is a groove-like depression arranged in the circumferential direction of the bonding part 41. A movement of the projecting part 13 rotating in the circumferential direction of the bonding part 41 can be stopped at a position half the length in the circumferential direction of the outer peripheral curved surface of the split section when each split section is seen from the direction perpendicular to the main surface of the slit 41*a*. In other words, the recessed part 44 has two side walls that face each other. One end of the side walls is open for the insertion of the projecting part 13, and the other end of the side walls has a wall to stop the rotational movement of the projecting part 13.

In the first embodiment, the terminal part 42 of the base 40 is in a spiral shape so that the terminal part 42 is rotated and fixed to a lighting device. The recessed part 44 in a groove-like shape is arranged so as to stop the projecting part 13 at the above-described position, when the projecting part 13 moves along the groove (i) in the circumferential direction of the bonding part 41 and (ii) in the direction where the terminal part 42 rotated and fixed. The depth D2 of the recessed part 44 is set, for example, to 2.25 [mm]. Also, in the first variation of the recessed part, the width H2 of the bonding part 41 of the recessed part 44 in the longitudinal central axis direction is set to substantially 3.0 [mm] from the opening to the wall.

The terminal part 42 is not limited to the above-described shapes as long as the terminal part 42 has a structure in which the terminal part 42 is rotated to be fixed to the lighting device.

Also, the position of the wall for stopping the above-described rotational movement of the projecting part 13 is not limited to the above. The position may be shifted to either way of the circumferential direction from the position half the length in the circumferential direction of the outer peripheral curved surface of the split section when each split section is seen from the direction perpendicular to the main surface of the slit 41*a*. However, it is preferable that the wall is arranged in the above-described position, so that the below-described fall-off prevention is effective. Furthermore, it is more preferable when the wall is shifted from the above-described position to the direction of movement of the projecting part 13, since the below-described fall-off prevention is even more effective.

(Second and Third Variations of Recessed Part)

Figure 4A:
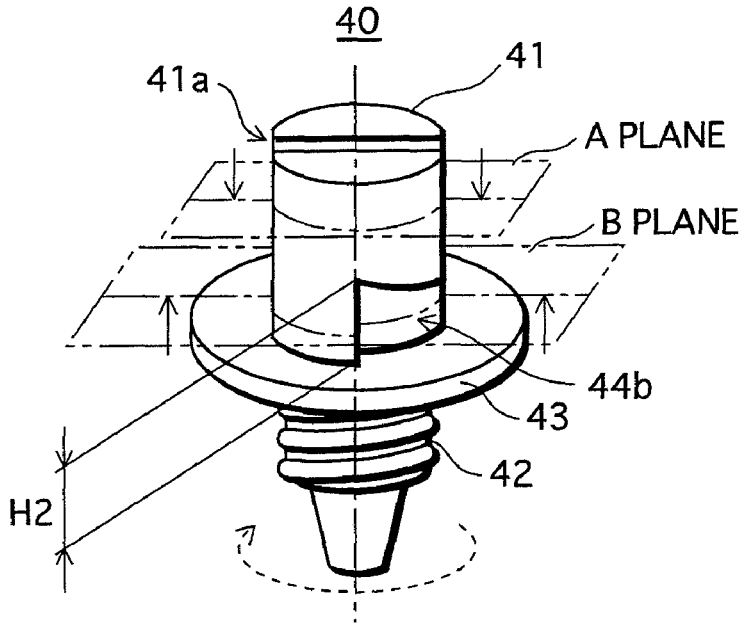
FIG. 4A is a schematic structure view showing a second variation of a recessed part arranged in a bonding part of the base in the first embodiment.
Figure 4B:
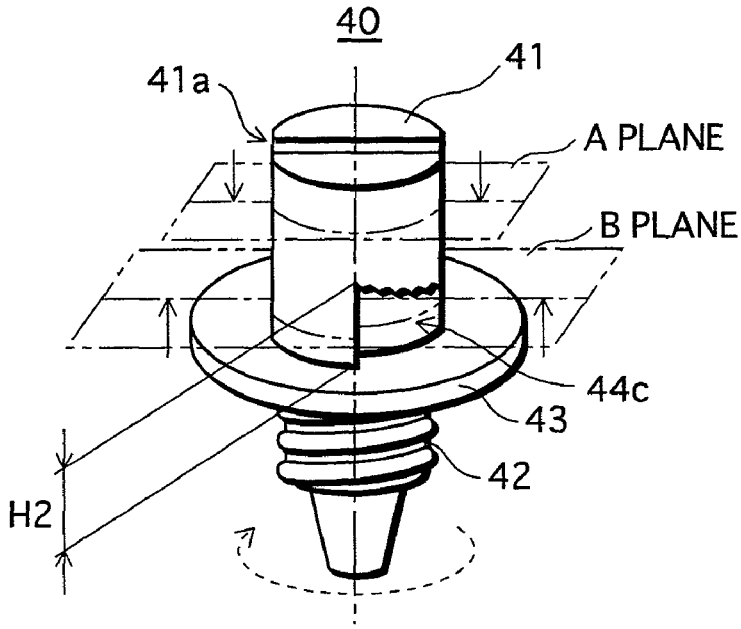
FIG. 4B is a schematic structure view showing a third variation of the recessed part arranged in the bonding part of the base in the first embodiment.

FIG. 4A is a schematic structure view showing a second variation of the recessed part, and FIG. 4B is a schematic structure view showing a third variation of the recessed part. The difference between (i) the second and third variations of the recessed part and (ii) the first variation thereof is the width of the recessed part in the longitudinal direction thereof (circumferential direction of the bonding part 41). (i) A side wall of the recessed part 44*b* positioned lower than the other side wall thereof and (ii) a side wall of the recessed part 44*c* positioned lower than the other side wall thereof are formed in a manner that, when the lamp is fixed so that the light is irradiated in the vertically downward direction, the further the projecting part 13 is inserted, the larger the width H2 is in series (see FIG. 4A) in the second variation, and in a manner that the further the projecting part 13 is inserted, the larger the width H2 is in stages (see FIG. 4B). For example, in the recessed parts 44*b* and 44*c*, the width H2 of the opening in which the projecting part 13 is inserted is assumed to be 4.0 [mm] Then, the width H2 is assumed to increase to be 5.0 [mm] either in series or in stages. This prevents the protective tube 11 from being rotated by vibration from outside and falling off the base 40, even in a situation where the adhesively-bonded part between the protective tube 11 and the base 40, which constitutes one form of a first fall-off prevention structure, deteriorates and the protective tube 11 and the base 40 are latched only by the projecting part 13 and the recessed parts 44*b* and 44*c*. Therefore, the fall-off prevention of the recessed parts 44*b* and 44*c* shown in the second and third variations of the recessed part, which constitute one form of a second fall-off prevention structure, is more effective than that of the recessed part 44 shown in the first variation of the recessed part.

(Fourth and Fifth Variations of Recessed Part)

Figure 5A:
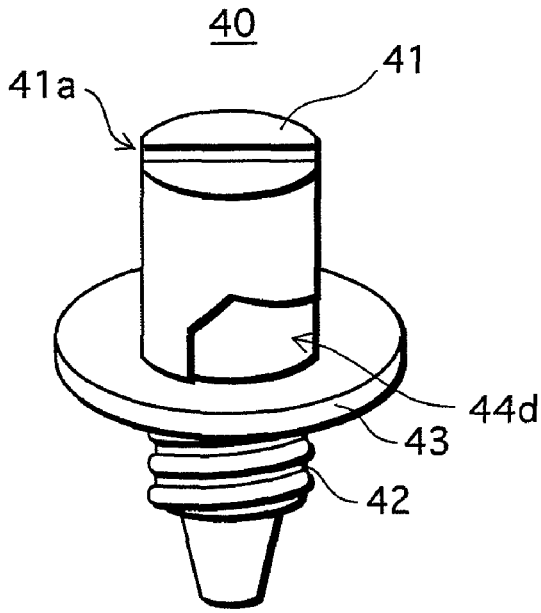
FIG. 5A is a schematic structure view showing a fourth variation of the recessed part arranged in the bonding part of the base in the first embodiment.
Figure 5B:
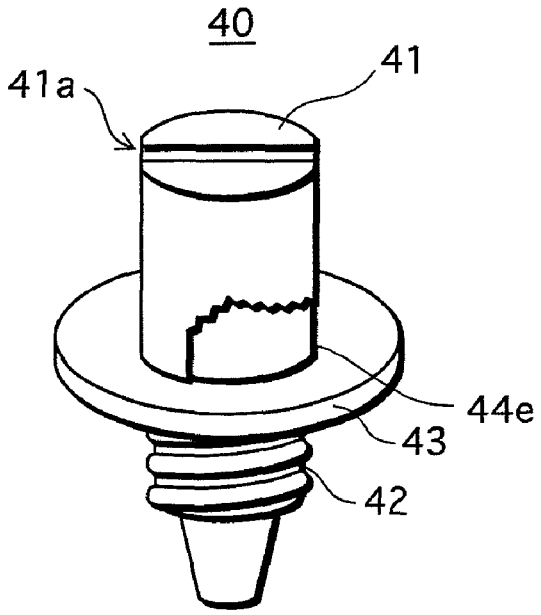
FIG. 5B is a schematic structure view showing a fifth variation of the recessed part arranged in the bonding part of the base in the first embodiment.

FIG. 5A is a schematic structure view showing a fourth variation of the recessed part, and FIG. 5B is a schematic structure view showing a fifth variation of the recessed part. The difference of the fourth and fifth variations of the recessed part and the first, second, and third variations thereof is the width of the recessed part in the longitudinal direction of the recessed part (circumferential direction of the bonding part 41). In the fourth and the fifth variations of the recessed part, the width H2 is formed so as to be (i) larger in series the further the projecting part 13 is inserted, and smaller in series after reaching the maximum width on the way, or (ii) larger in stages the further the projecting part 13 is inserted, and smaller in stages after reaching the maximum width on the way. For example, in the recessed parts 44*d* and 44*e*, the width H2 of the opening for inserting the projecting part 13 is assumed to be 3.0 [mm] and increases in series or in stages up to 5.0 [mm]. This prevents the protective tube 11 from being rotated by vibration from outside and falling off the base 40, even in a situation where the adhesively-bonded part between the protective tube 11 and the base 40 deteriorates and the protective tube 11 and the base 40 are latched only by the projecting part 13 and the recessed parts 44*d* and 44*e*.

Furthermore, in the fourth and fifth variations of the recessed part that have the above-described structure, the degrees of the maximum width parts of the recessed parts 44*d* and 44*e* for latching the projecting part 13 are obtuse when the maximum width parts are seen from the radial direction of the bonding part 41 in the maximum width part, while the degrees of the maximum width parts of the recessed parts 44*b* and 44*c* that have a function for latching the projecting part 13 are acute in the second and third variations of the recessed part when the maximum width parts are seen from the radial direction of the bonding part 41 in the maximum width part. Therefore, the parts in which the widths H2 of the recessed parts 44*d* and 44*e* are at maximum are securely formed, without being affected by the materials of the bonding part 41 in the base 40, and the processing accuracy thereof. As a result, the projecting part 13 of the protective tube 11 is securely fixed to the maximum width part, compared to the second and third variations of the recessed part, thereby securely preventing the protective tube 11 from falling off, compared to the second and third variations even in a situation where the adhesively-bonded part deteriorates and the protective tube 11 and the base 40 are latched only by the projecting part 13 and the recessed parts 44*d* and 44*e*.

Note that in the fourth and fifth variations of the recessed part, the part where the width H2 is at maximum is arranged in the position half the length in the circumferential direction of the outer peripheral curved surface of the split section when the each split section is seen from the direction perpendicular to the main surface of the slit 41*a*. Here, the position may be shifted to either way of the circumferential direction from the position half the length in the circumferential direction of the outer peripheral curved surface of the split section. However, it is preferable that the maximum width part is arranged in the above-described position, so that the above-described fall-off prevention is effective. Also, it is more preferable when the maximum width part is shifted from the above-described position to the direction of the movement of the projecting part 13 so that the fall-off prevention is fully effective.

(First Variation of Bonding part)

The following describes the first variation of the bonding part. As shown in FIGS. 3B and 3C, the outer peripheral surface of the bonding part 41 that is substantially cylindrical has two flat surfaces, which are created by cutting the peripheral surface of a cylinder so as to be parallel to each other along the longitudinal central axis of the bonding part 41. The above-described recessed parts 44, 44*b*, 44*c*, 44*d*, and 44*e* are formed in a shape of groove in the circumferential direction from each side that is parallel to the longitudinal central axis direction of the bonding part 41 in the two flat surfaces.

(Second Variation of Bonding part)

Figure 6A:
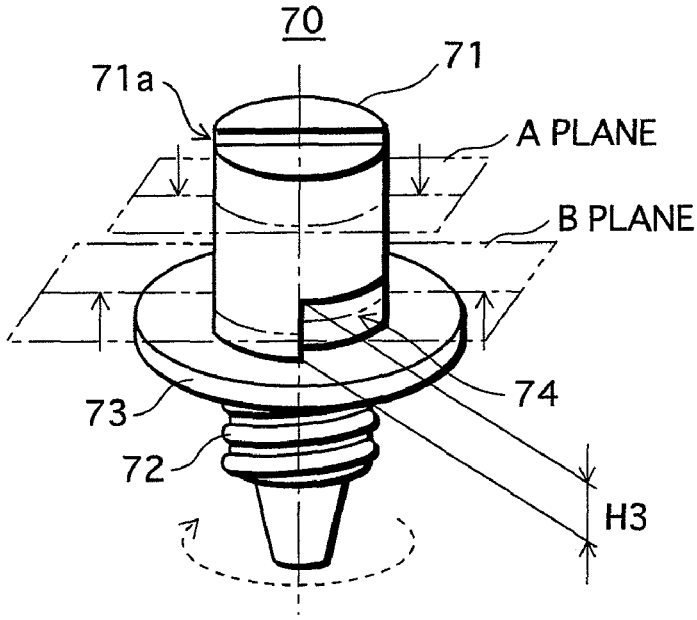
FIG. 6A is a schematic structure view showing a second variation of the bonding part of the base in the first embodiment.
Figure 6B:
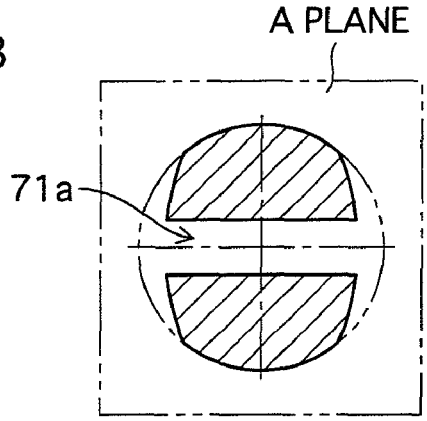
FIG. 6B is a sectional view showing the bonding part of the base taken along the plane A and viewed in the direction of the arrows.
Figure 6C:
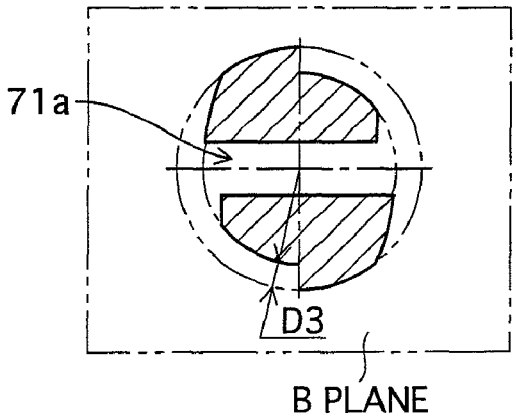
FIG. 6C is a sectional view showing the bonding part of the base taken along the plane B and viewed in the direction of the arrows.

FIG. 6A is a schematic structure view showing a second variation of the bonding part, FIG. 6B is a sectional view taken along the plane A and viewed in the direction of the arrows, and FIG. 6C is a sectional view taken along the plane B and viewed in the direction of the arrows. The outer peripheral surface of the bonding part 41 does not always have a structure shown in FIG. 3 in the first variation of the bonding part. Instead, as shown in FIG. 6, the curvature of the outer peripheral line of the flat surface perpendicular to the axis direction of the bonding part 71 may not be uniform. For example, in the flat surface perpendicular to the longitudinal central axis direction of the bonding part 41 as shown in FIG. 6, the shape of the outer peripheral line may be substantially in an elliptical shape. The reason for this is described below. Note that the measurements of D3 and H3 shown in FIG. 6 are the same as D2 and H2 shown in FIG. 3.

<Mating Relationship of Protective Tube 11, Airtight Tube 20, and Base 40>

Figure 7A:
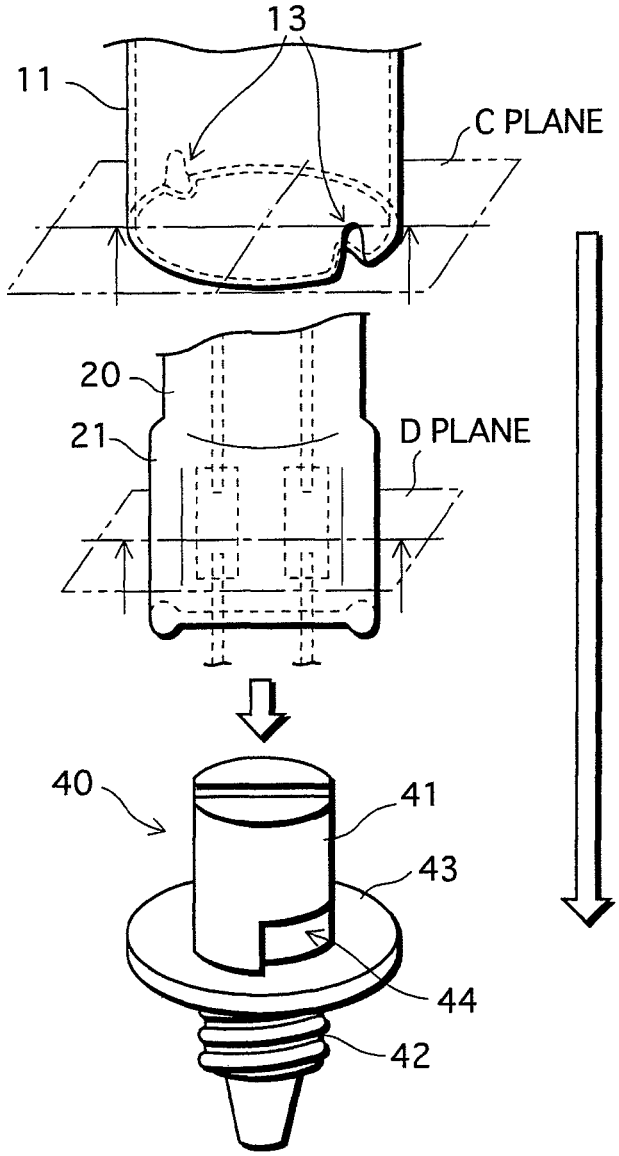
FIG. 7A is a main assembling process chart of the metal halide lamp in the first embodiment.
Figure 7B:
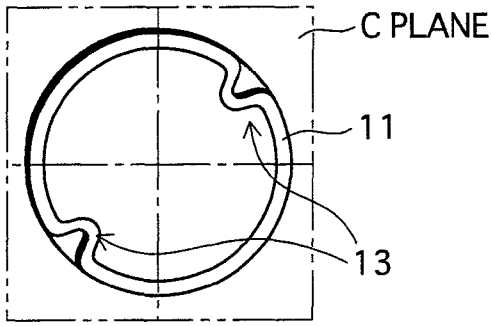
FIG. 7B is a sectional view showing an opening edge of the protective tube taken along the plane C and viewed in the direction of the arrows.
Figure 7C:
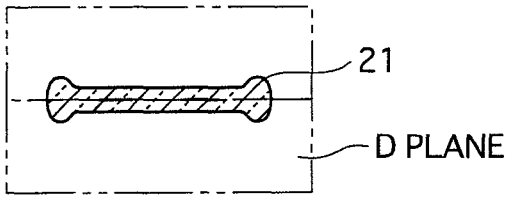
FIG. 7C is a sectional view showing a pinch seal part of an airtight tube taken along the plane D and viewed in the direction of the arrows.
Figure 8A:
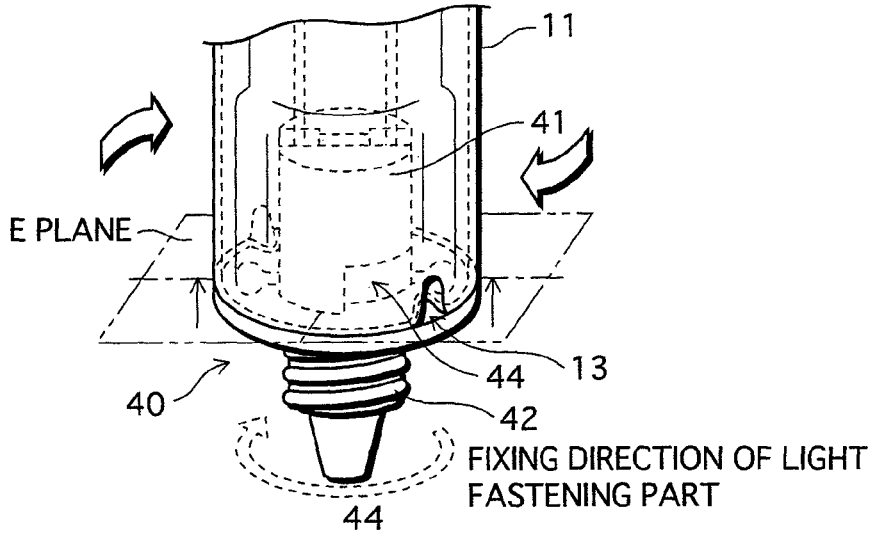
FIG. 8A is a main assembling process chart of a process of engaging (a) a projecting part of the protective tube with (b) the recessed part arranged in the bonding part of the base in the first embodiment.
Figure 8B:
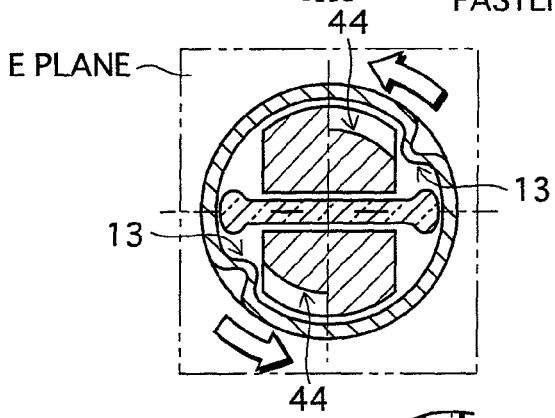
FIG. 8B is a sectional view taken along the plane E and viewed in the direction of the arrows, showing a bonded surface of the protective tube and a flange part of the base that are shown in FIG. 8A.

The following describes the mating relationship of the protective tube 11, airtight tube 20, and base 40. FIGS. 7 and 8 are the main assembling process charts of a metal halide lamp of the present embodiment. FIG. 7A is a schematic process chart showing an assembling order of the protective tube 11, airtight tube 20, and base 40, FIG. 7B is a sectional view taken along the plane C and viewed in the direction of the arrows, showing the opening edge of the protective tube 11, and FIG. 7C is a sectional view taken along the plane D and viewed in the direction of the arrows, showing the pinch seal part 21 of the airtight tube 20. FIG. 8A is a schematic process chart showing a process of engaging (a) the projecting part 13 of the protective tube 11 with (b) the recessed part 44 arranged in the bonding part of the base 40, FIG. 8B is a sectional view taken along the plane E and viewed in the direction of the arrows, and FIG. 8D is a sectional view taken along the plane F and viewed in the direction of the arrows.

As shown in FIG. 7A, the pinch seal part 21 of the airtight tube 20 is inserted in the slit 41*a* that is arranged in the bonding part 41 of the base 40, and bonded, for example, with a heat-resistant inorganic adhesive that withstands temperatures up to 1000° C. or higher such as Sumiceram (registered trademark, No. 1269142) manufactured by Asahi Chemical Industry Co., Ltd. and Bond X (registered trademark, No. 2598133) manufactured by Nissan Chemical Industries, Ltd. Then, the airtight tube 20 and the bonding part 41 are covered by the protective tube 11, in a manner that the opening edge of the protective tube 11 is in contact with the flange part 43 of the base 40. Here, the heat-resistant inorganic adhesive that withstands temperatures up to 1000° C. or higher is applied between the opening edge and the flange part 43. This means that the heat-resistant inorganic adhesive may mediate between the opening edge of the protective tube 11 and the flange part 43 of the base 40.

As described above, two flat surfaces are provided on the peripheral surface of the bonding part 41 of the base 40, so as to be parallel to each other along the longitudinal central axis of the bonding part 41. Therefore, even in a case of adopting the protective tube 11 whose inner diameter approximates the outer diameter of the airtight tube 20, the projecting part 13 arranged in the protective tube 11 can reach the surface of the flange part 43 that is to be bonded to the opening edge of the protective tube 11 (FIGS. 8A and 8B).

As shown in FIG. 8A, the base 40 is fixed while the opening edge of the protective tube 11 is in contact with the flange part 43 of the base 40, and the protective tube 11 is rotated in the same direction as the direction where the terminal part 42 is rotated to be fixed to a lighting device.

Figure 8C:
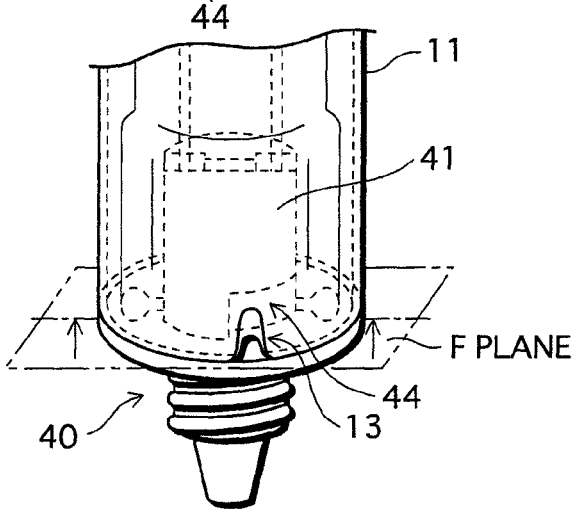
FIG. 8C is a main assembling process chart, showing a state where the process of engaging (a) the projecting part of the protective tube with (b) the recessed part arranged in the bonding part of the base has been completed.
Figure 8D:
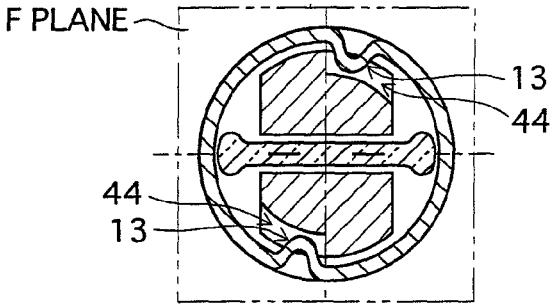
FIG. 8D is a sectional view taken along the plane F and viewed in the direction of the arrows, showing a bonded surface of the protective tube and the flange part of the base shown in FIG. 8C.

Then, as shown in FIGS. 8C and 8D, the projecting part 13 of the protective tube 11 is moved in the recessed part 44 arranged in the bonding part 41 of the base 40, and latched by the recessed part 44. In this state, the applied inorganic adhesive is baked to bond the opening 12 of the protective tube 11 and the flange part 43 of the base 40.

<Others>

Figure 9A:
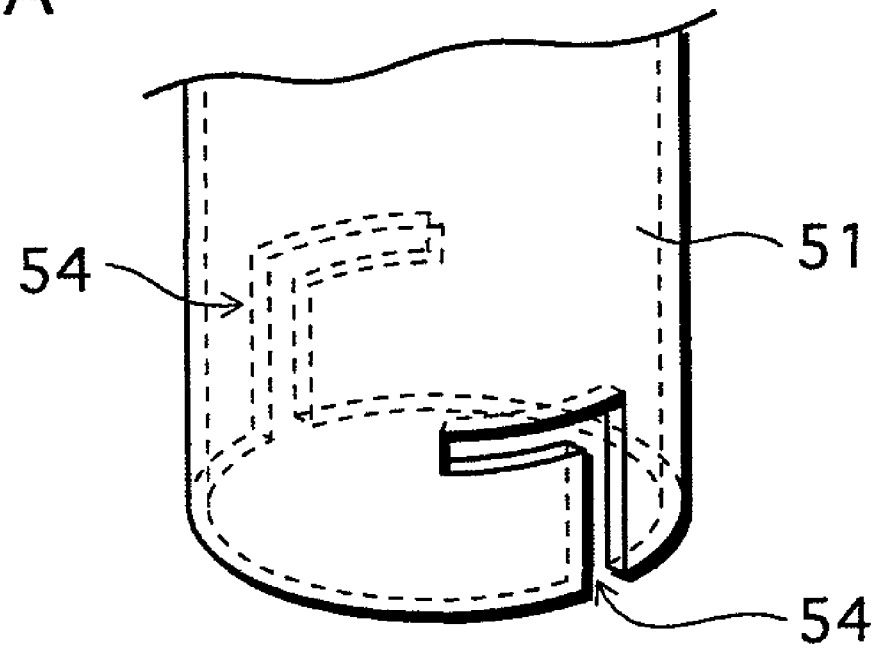
FIG. 9A is a schematic structure view showing another variation of the protective tube.
Figure 9B:
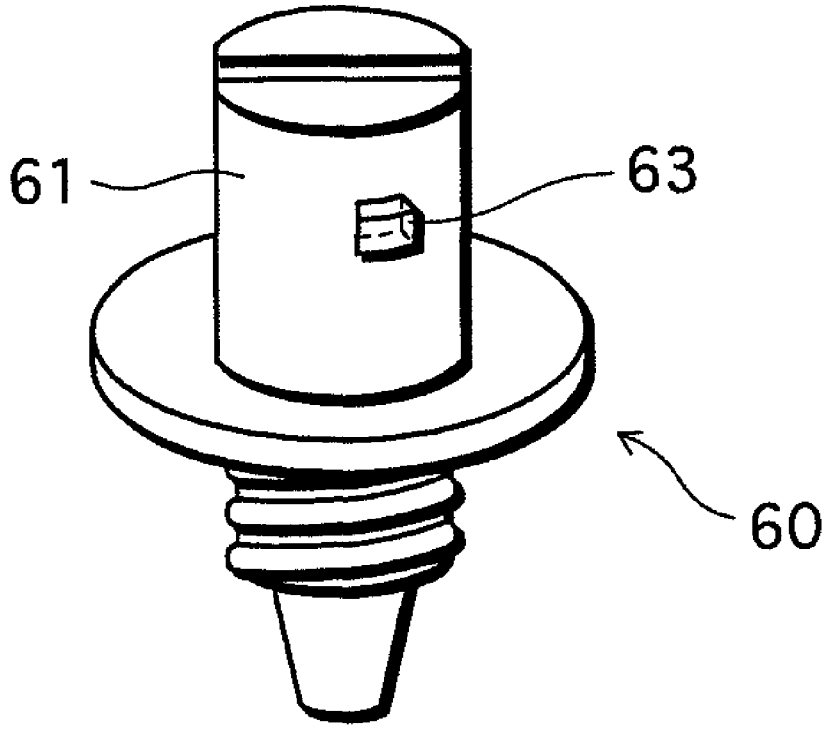
FIG. 9B is a schematic structure view showing a third variation of the bonding part of the base.

The relationship between the projecting part of the protective tube 11 and the recessed part of the base 40 may be reversed. In other words, the recessed part may be provided for the protective tube 11, and the projecting part may be provided for the bonding part 41 of the base 40. FIG. 9A is a schematic structure view showing another variation of the protective tube, and FIG. 9B is a schematic structure view showing a third variation of the bonding part of the base. For example, as shown in FIG. 9A, notches 54 that are each substantially in an L shape may be arranged in a protective tube 51, and a projecting part 63 may be arranged on the outer peripheral surface of a bonding part 61 of a base 60, so that the protective tube 51 is latched to the base 60 when a force including gravity and inertia acts on the protective tube 51 toward the closed end thereof in the longitudinal direction of the protective tube 51.

Also, as described above, in the bonding part 41, the curvature of the outer peripheral line of the flat surface perpendicular to the axis direction of the bonding part 41 may not be uniform. For example, as shown in FIG. 6, in a case where the shape of the outer peripheral line of the flat surface is substantially in an elliptical shape, an area having a lower curvature of the ellipse can be arranged on surfaces corresponding to the above-described two flat surfaces that are parallel to each other. In this way, after the pinch seal part 21 of the airtight tube 20 is inserted in the slit 71*a* of the bonding part 71, the projecting part 13 of the protective tube 11 reaches the main surface of a flange part 73 of a base 70 without the interference of the bonding part 71.

More specifically, in the flat surface perpendicular to the longitudinal direction of the bonding part 71, any shape of the outer peripheral line of the bonding part 71 is acceptable as long as it is determined in a manner that (i) the projecting part 13 of the protective tube 11 reaches the main surface of the flange part 73 after the pinch seal part 21 of the airtight tube 20 is inserted in the slit of the bonding part 71, and also (ii) the protective tube 11 is prevented from falling off by being rotated in the circumferential direction of the protective tube 11 after the projecting part 13 reaches the main surface of the flange part 73, namely the protective tube 11 is prevented from falling off by the projecting part 13 of the protective tube 11 being latched by the recessed part 74 of the bonding part 71 when a force including gravity and inertia acts on the protective tube toward the closed end of the protective tube along the axial direction thereof.

Figure 10:
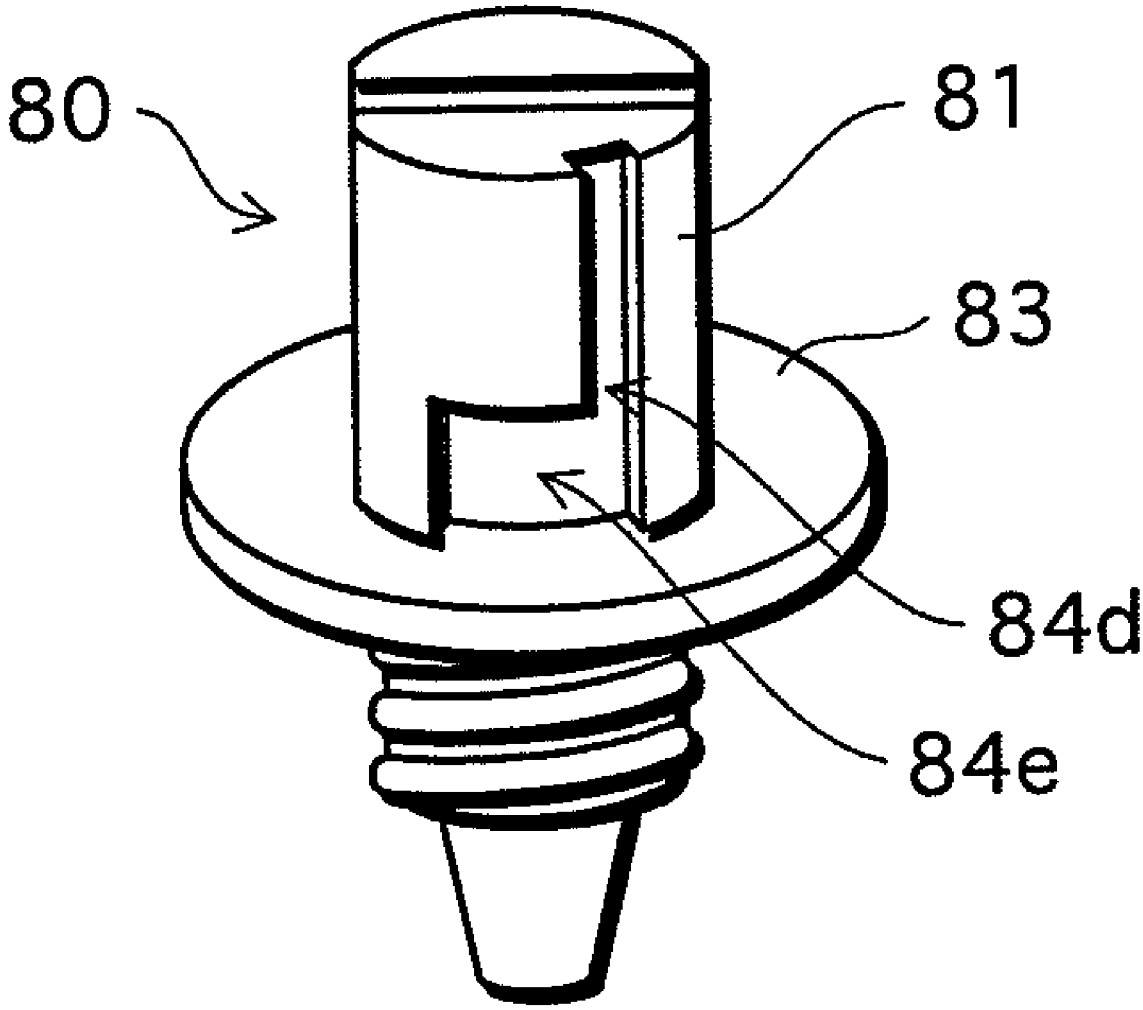
FIG. 10 is a schematic structure view showing a sixth variation of the recessed part arranged in the bonding part of the base.
Figure 11:
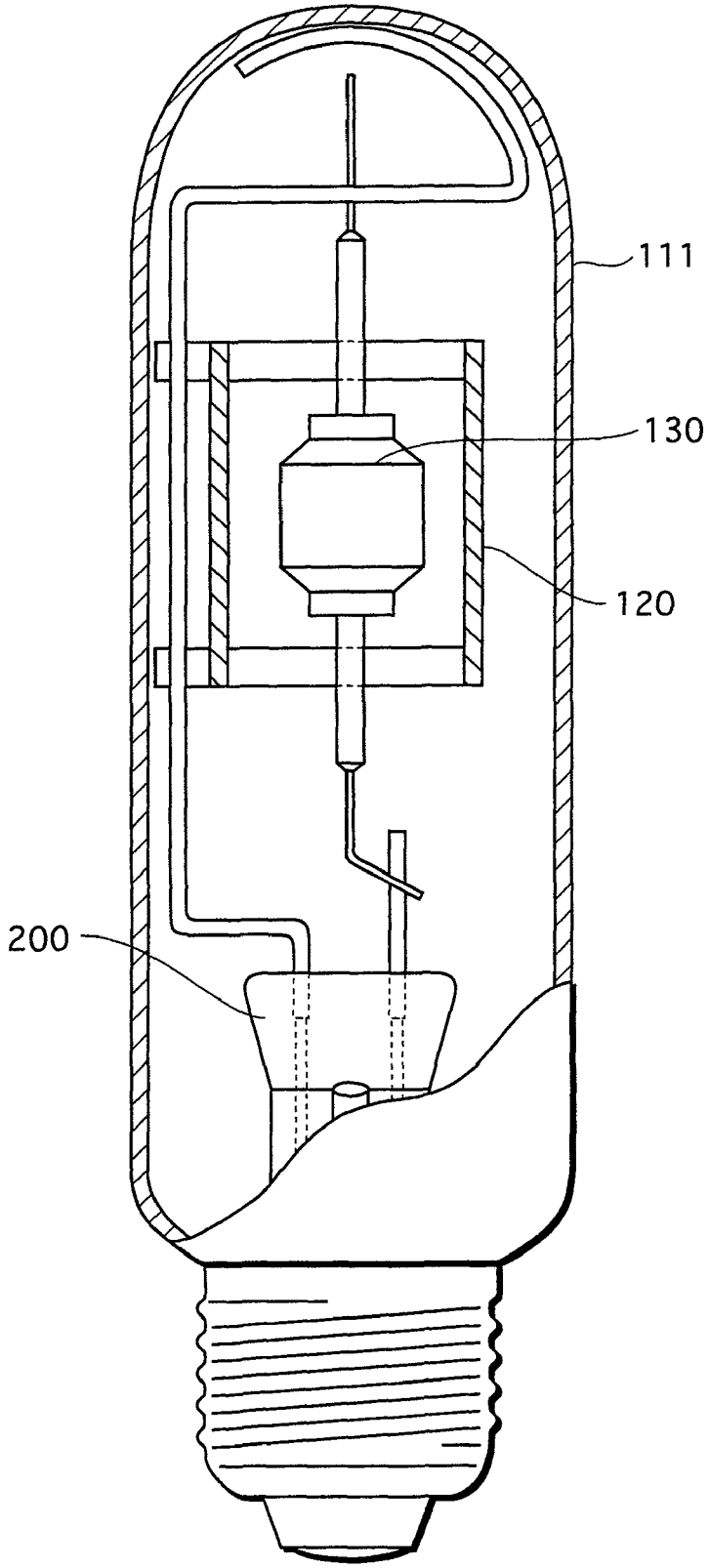
FIG. 11 is a schematic exploded view showing a first conventional metal halide lamp.
Figure 12:
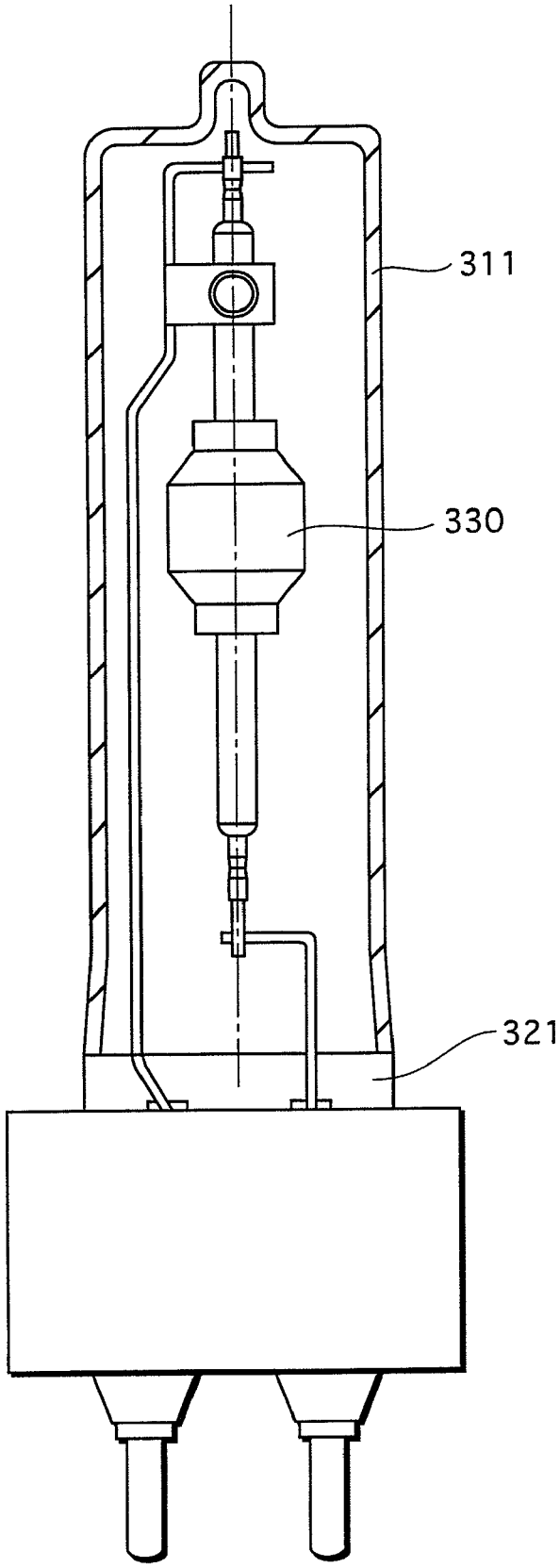
FIG. 12 is a schematic exploded view showing a second conventional metal halide lamp.

As shown in FIG. 10, it is also possible that (i) a first recessed part 84*d* is arranged on the outer peripheral surface of a bonding part 81 of a base 80 from the end face to the axial direction, and (ii) a second recessed part 84*e* is arranged substantially in the circumferential direction of the bonding part 81, in communication with the first recessed part 84*d*. The above-described structure also ensures that the projecting part 13 reaches the main surface of the flange part 83 of the base 80. FIG. 10 is a schematic structure view of the base 80, showing a sixth variation of the recessed part.

Any combination of (i) the above described second, third, fourth, fifth, and sixth variations of the recessed part (see FIGS. 4, 5, and 10) and (ii) the above described first and second variations of the bonding part (see FIGS. 3 and 6) is acceptable. In other words, it is possible to arrange any of the recessed parts 44*b*, 44*c*, 44*d*, and 44*e* in the bonding part 71. It is also possible to arrange a recessed part that is made by communicating the first recessed part 84*d* with the second recessed part 84*e*.

It is also possible to combine the sixth variation of the recessed part (see FIG. 10) with any of the second, third, fourth, and fifth variations of the recessed part (see FIGS. 4 and 5). In other words, the first recessed part 84*d* may be combined with any of the recessed parts 44*b*, 44*c*, 44*d*, and 44*e*.

In the recessed part 44 which is the first variation of the recessed part, a side wall positioned lower (positioned higher in FIG. 3) than the other can of course be formed to have a rough surface when the lamp is fixed so that the light of the lamp is irradiated in the vertically downward direction.

Also, the projecting part 13 of the protective tube 11 may be arranged more inward than the opening edge of the protective tube 11, as long as the recessed part 44 can be arranged on the outer peripheral surface of the bonding part 41 so as to latch the projecting part 13 of the protective tube 11. For example, the recessed part 44 may be arranged in the above-described manner, in an area that is (i) on the outer peripheral surface of the bonding part 41 and (ii) in the middle of the axial direction thereof. Then, the projecting part 13 may be arranged on the inner peripheral surface of the protective tube 11 so as to be latched by the recessed part 44 of the bonding part 41. The protective tube 11 whose projecting part 13 is arranged at the opening edge of the protective tube 11 is of course more advantageous than the protective tube 11 whose projecting part 13 is arranged more inward than the opening edge, since forming the projecting part 13 at the opening edge is easier than forming the projecting part 13 more inward than the opening edge.

<<Effect of Metal Vapor Discharge Lamp in First Embodiment>>

In the metal vapor discharge lamp in the present embodiment, the flange part 43 is arranged in the base 40, the protective tube 11 covers the airtight tube 20 that houses the arc tube 30, and the opening edge of the protective tube 11 and the flange part 43 are bonded with use of an inorganic adhesive. Therefore, the safety against the breakage of the arc tube 30 and harmful ultraviolet irradiation is ensured.

Also, in the metal vapor discharge lamp according to the present embodiment, the projecting part 13 that is a latched part arranged on the inner peripheral surface at the opening of the protective tube 11 is in an engagement relationship with the recessed part 44 that is a latching part arranged on the outer peripheral surface of the bonding part 41 of the base 40. Therefore, even though a force including gravity and inertia acts on the protective tube toward the closed end of the protective tube along the axial direction thereof, the recessed part 44 in the bonding part 41 of the base 40 latches the projecting part 13 in the opening 12 of the protective tube 11.

As a result, even if the inorganic adhesive for bonding the opening 12 of the protective tube 11 to the flange part 43 of the base 40 has completely lost the bonding function, the protective tube 11 does not easily fall off. Therefore, the safety of the metal discharge lamp of the present invention is higher than the discharge lamp whose protective tube is simply bonded to the base with an inorganic adhesive.

Furthermore, in the metal vapor discharge lamp whose bonding function of the adhesive is practically maintained, the projecting part 13 may not be latched by the recessed part 44 because of the inorganic adhesive therebetween. However, when the bonding function of the adhesive has practically lost its function, the projecting part 13 is latched to prevent the protective tube from falling off. With this double fall-off prevention, the metal vapor discharge lamp according to the present invention has a higher safety than a discharge lamp whose protective tube is simply bonded to the base with use of an inorganic adhesive.

Also, in the metal vapor discharge lamp according to the present invention, the protective tube 11, which is strong enough to resist a burst of the arc tube 30 and made of hard glass that can absorb ultraviolet rays having a lower wavelength that cannot be absorbed by the airtight tube 20, is prevented from easily falling off. Therefore, the safety against a burst of the arc tube 30 and harmful ultraviolet irradiation is more improved than a discharge lamp whose protective tube is simply bonded to the base with use of a heat-resistant adhesive.

In the metal vapor discharged lamp, the recessed part 44 that latches the protective tube 11 is arranged on the outer peripheral surface of the bonding part 41 in which the pinch seal part 21 of the airtight tube 20 is inserted. Therefore, (i) the bonding member that bonds the airtight tube 20 to the base 40, and (ii) an engaging member for latching the protective tube 11 to the base 40 can be integrated into one in the bonding part 41. Therefore, compared to a case where the protective tube is bonded to the base by crimping the base, and a stem is provided in the vicinity of an opening of the protective tube, the length of the protective tube 11 in the axial direction thereof is shorter. In other words, the length of the metal vapor discharge lamp in the axial direction is shorter, which makes it possible to prevent the metal vapor discharge lamp from becoming large in size.

Also, the metal vapor discharge lamp is easy to manufacture because of the above-described engagement structure in which the protective tube 11 is bonded to the base 40 with use of an inorganic adhesive.

Furthermore, the metal vapor discharge lamp having the above-described structure eliminates the need of providing, for an open bottom type lighting device on which the metal vapor discharge lamp is to be mounted, a front glass that is made of hard glass. Therefore, a member for fixing the front glass is not necessary, which makes it possible to provide a smaller and lighter lighting device.

Also, in the metal vapor discharge lamp, the recessed part 44 in a groove-like shape is arranged in the circumferential direction of the protective tube 11, so as to latch the projecting part 13 in the direction of the base 40 being rotated to be fixed to the lighting device. Therefore, it is possible to prevent the protective tube 11 from falling off when the metal vapor discharge lamp is being fixed to the lighting device.

Furthermore, in the present embodiment, when the bonding part 41 of the base 40 is made of a powdery material such as steatite ceramics and molded with use of powder processing, molding the recessed part 44 that is a latching part on the side of the base is easier than molding a recessed part of a lamp in which the outer peripheral surface of the protective tube and the inner peripheral surface of the base have an engagement relationship. With the same reasons, it is also easy to mold the projecting part 63 as the latching part on the side of the base.

INDUSTRIAL APPLICABILITY

The present invention makes it possible to provide a protective tube that ensures safety against the breakage of an arc tube and harmful ultraviolet irradiation while preventing a metal vapor discharge lamp from being large in size. Also, it is possible to prevent the protective tube from falling off. Therefore, the present invention is suitable for the headlights of transport machinery and such, and the industrial applicability thereof is remarkably wide and high.

The invention claimed is:

1. A metal vapor discharge lamp comprising:

an arc tube;

an airtight tube housing the arc tube; and a base bonded to one end of the airtight tube with use of an adhesive; and a protective tube covering the airtight tube, wherein the protective tube has been fixed to the base by a double fall-off prevention structure including a first fall-off prevention structure for bonding with use of the adhesive and a second fall-off prevention structure for latching with use of a latching part provided on the base and a latched part provided on the protective tube, so that the protective tube is prevented from falling off the base.

2. The metal vapor discharge lamp of claim 1, wherein the one end of the airtight tube is pinch-sealed, the one end that has been pinch-sealed is inserted in a bonding part of the base, the bonding part is inserted in an opening of the protective tube, and the latching part is arranged in the bonding part.

3. The metal vapor discharge lamp of claim 2, wherein the bonding part has an outer peripheral surface on which the latching part is arranged.

4. The metal vapor discharge lamp of claim 1, wherein the latched part and the latching part are one of (i) a combination in which (a) the latched part is a projecting part arranged on an inner peripheral surface of the protective tube in a radial direction thereof, and (b) the latching part is a recessed part arranged on a surface opposite from the inner peripheral surface of the protective tube in the bonding part, and latches the projecting part of the protective tube, and, (ii) a combination in which (a) the latched part is a recessed part arranged on a surface opposite from the outer peripheral surface of the bonding part, and (b) the latching part is a projecting part arranged on the surface opposite from the inner peripheral surface of the protective tube in the bonding part in a radial direction thereof, and latches the recessed part of the bonding part.

5. The metal vapor discharge lamp of claim 4, wherein the base is rotated and fixed to a socket corresponding thereto, and the recessed part latches the projecting part when the base is rotated.

6. A lighting device in which the metal vapor discharge lamp of claim 1 is mounted.

* * * * *